US006860745B1

(12) United States Patent
Bolen et al.

(10) Patent No.: US 6,860,745 B1
(45) Date of Patent: Mar. 1, 2005

(54) MODULAR CLOCKSPRING

(75) Inventors: Pat A. Bolen, Carthage, IL (US); Christopher K. Wyatt, Hamilton, IL (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 10/646,889

(22) Filed: Aug. 25, 2003

(51) Int. Cl.[7] ..... H01R 3/00
(52) U.S. Cl. ..... 439/164
(58) Field of Search ..... 439/164, 15, 545

(56) References Cited

U.S. PATENT DOCUMENTS

| | | | | | |
|---|---|---|---|---|---|
| 5,226,831 | A | * | 7/1993 | Horiuchi | 439/164 |
| 5,230,713 | A | | 7/1993 | Schauer | |
| 5,238,420 | A | * | 8/1993 | Miyahara et al. | 439/164 |
| 5,246,377 | A | * | 9/1993 | Kawahara et al. | 439/164 |
| 5,286,219 | A | * | 2/1994 | Ueno et al. | 439/475 |
| 5,310,356 | A | | 5/1994 | Obata et al. | |
| 5,593,310 | A | | 1/1997 | Kawamoto et al. | |
| 5,630,723 | A | * | 5/1997 | Kawamoto | 439/164 |
| 5,651,687 | A | * | 7/1997 | Du-Rocher et al. | 439/164 |
| 5,704,633 | A | | 1/1998 | Durrani et al. | |
| 5,752,843 | A | | 5/1998 | Kawamoto et al. | |
| 5,762,507 | A | | 6/1998 | Mochizuki et al. | |
| 5,769,649 | A | | 6/1998 | Welschholz et al. | |
| 5,915,983 | A | * | 6/1999 | Ishikawa et al. | 439/164 |
| 5,928,018 | A | * | 7/1999 | Dumoulin | 439/164 |
| 6,012,947 | A | | 1/2000 | Zann et al. | |
| 6,026,563 | A | | 2/2000 | Schilson | |
| 6,095,836 | A | | 8/2000 | Bolen et al. | |
| 6,299,454 | B1 | * | 10/2001 | Henderson et al. | 439/19 |
| 6,390,838 | B1 | * | 5/2002 | Kawamura | 439/164 |
| 6,409,527 | B1 | * | 6/2002 | Adachi et al. | 439/164 |
| 6,437,250 | B2 | | 8/2002 | Sugata | |
| 2001/0028196 | A1 | | 10/2001 | Burr et al. | |

FOREIGN PATENT DOCUMENTS

| | | |
|---|---|---|
| EP | 000486867 | 5/1992 |

* cited by examiner

*Primary Examiner*—Ross Gushi
*Assistant Examiner*—Phuongchi Nguyen
(74) *Attorney, Agent, or Firm*—Blank Rome LLP

(57) ABSTRACT

The present invention is directed to a modular clockspring to be used in automobile steering columns that allow modular parts of the clockspring to be modified without the need to alter the design of the entire clockspring. The clockspring is composed of at least six modules, a cover module, a housing module, an inner diameter (ID) connector module, an outer diameter (OD) connector module, a locking module, and a flat electrical cable module. The modular nature of the clockspring allows a single generic clockspring to be used in various steering columns. Minor differences in mounting styles, connector styles or the number of circuits within the differing steering columns can be accommodated with minor changes to the relevant modules without having to redesign the entire clockspring.

10 Claims, 6 Drawing Sheets

MODULAR CLOCKSPRING

FIELD OF INVENTION

The present invention relates to modular clocksprings used in automobiles that allow rotating members to maintain a continuous electrical connection to stationary members. In particular, the modular clockspring comprises multiple modules that may be individually modified without affecting the function of the other modules, so that specific modules may be modified to be used within different automobiles without having to redesign the entire clockspring.

BACKGROUND OF THE INVENTION

While the present invention may have multiple applications, the most prevalent is for use in automobiles. An increasing number of automobiles have airbag crash systems. An airbag is typically located on the steering wheel facing the driver. The airbag must be in continuous electrical connection with sensors in the car body which provide an electrical signal to the airbag crash assembly which instantly inflates the airbag in the event of a crash. Clocksprings are found in virtually every vehicle to electrically connect rotating devices in the steering column to stationary components in other parts of the vehicle.

Because of the large number of types and models of vehicles, oftentimes, minor modifications are necessary to the clockspring so that it matches the requirements of the corresponding vehicle. Usually, these differences are in mounting styles, connector styles, or the number of circuits within the clockspring. Differences in any one of these features up to now has required a complete redesign of the entire clockspring, resulting in higher costs and longer lead times for the production of the clockspring.

The present invention provides a modular clockspring that may be used in different vehicles, by changing any one of the modules on the clockspring to meet the particular vehicle requirements. Clocksprings having multiple modules are not new in the art. U.S. Pat. No. 5,226,831 to Horiuchi and U.S. Pat. No. 5,286,219 to Ueno et al. disclose such clocksprings. However, these clocksprings have multiple modules to facilitate their assembly, and have generally been designed to limit the number of modules in order to keep the assembly process simple. For example, Horiuchi states in the Summary of the Invention, that an object of the invention is to "permit easy installation of the flat cable connecting portions to cases and which has [a] minimized number of required parts." The prior art clocksprings were not designed with the intent of having modules capable of being easily modified to accommodate specific functional and design needs of multiple vehicles.

SUMMARY AND OBJECTS OF THE INVENTION

The present invention is directed to a modular clockspring to be used in automobile steering columns that allow modular parts of the clockspring to be modified without the need to alter the design of the entire clockspring. The clockspring is made up of at least six modules, a cover module, a housing module, an inner diameter (ID) connector module, an outer diameter (OD) connector module, a locking module, and a flat electrical cable module.

The housing module and cover module are mated to form an enclosure for the flat cable module, with the flat cable module being wound around a hub located on the cover module. The inner and outer ends of the flat electrical cable are secured to the ID connector module and the OD connector module, respectively. The ID connector module extends through an opening in the cover module for attachment to electrical components within a steering column. The OD connector module is positioned around an outside circumferential edge of the housing for connection to other stationary components in the vehicle. The locking module engages the OD connector module to lock the OD connector module to the housing module.

The modular nature of the clockspring allows a single generic clockspring to be used in various steering columns. Minor differences in mounting styles, connector styles or the number of circuits within the differing steering columns can be accommodated with changes to the relevant modules without having to redesign the entire clockspring. For example, variations in the type of connector used in vehicles can be accommodated by modifying either the ID or OD connector module, without altering the remaining modules of the clockspring.

Therefore, it is an object of the invention to provide a modular clockspring which allows various modules thereon to be modified to meet the specific requirements of a vehicle, without having to modify the remaining modules of the clockspring. It is further an object of the invention to identify those modules which vary most frequently between systems and isolate those modules in the clockspring so that they may be modified without affecting the other modules of the clockspring. It is yet a further object of the invention to provide a modular clockspring that may be redesigned in a simple and efficient manner, thereby reducing the overall cost of producing the clockspring.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE INVENTION

Figure 1:
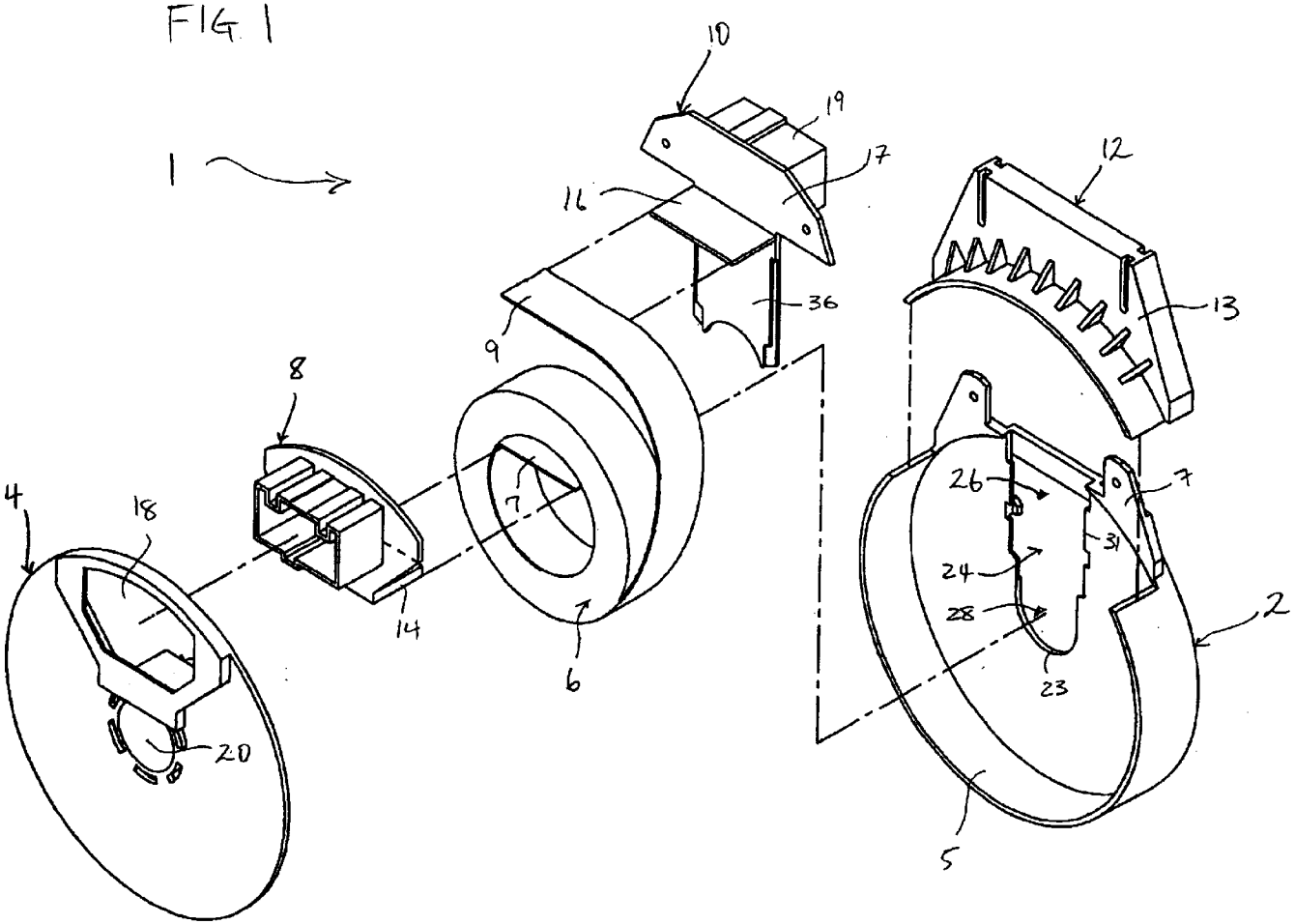
FIG. 1 is an exploded perspective view of a clockspring of the present invention.

Referring now in detail to the drawings, FIG. 1 shows an exploded view of the modules of a modular clockspring 1, comprising a housing module 2, a cover module 4, a flat electrical cable module 6, an inner diameter (ID) connector module 8, an outer diameter (OD) connector module 10 and a locking module 12.

The flat cable 6 is of the type that is well know in the art to be used with clocksprings. The flat cable 6 has an inner end 7 and an outer end 9 attached to the ID connector module 8 and the OD connector module 10, respectively. Although connection to the ID and OD connector modules 8 and 10 can be accomplished in one of any number of ways, a preferred method, as shown in FIG. 1, shows that both the ID connector module 8 and the OD connector module 10 include flat wall portions 14 and 16, respectively, that mate with the inner and outer ends 7 and 9 of the flat cable 6.

The several modules of the clockspring and how they fit with one another will now be explained. The ID connector module 8 is inserted through an opening 18 in the cover 4. The cover 4 has a hub 20, as best shown in FIGS. 4 and 4A, around which the flat cable 6 is wound. FIGS. 4 and 4A show the ID connector module 8 and the flat cable 6, before and after attachment to the cover 4. In assembling the clockspring 1, the flat cable 6 and the ID connector module 8 must be secured to the cover 4, as shown in FIG. 4A, prior to attachment to the housing 2. This is because after the cover 4 and the housing 2 are assembled (shown in FIG. 3), there is no access to the interior of the housing 2, so that it would be impossible to insert the flat cable 6 and the ID connector module 8.

Figure 3:
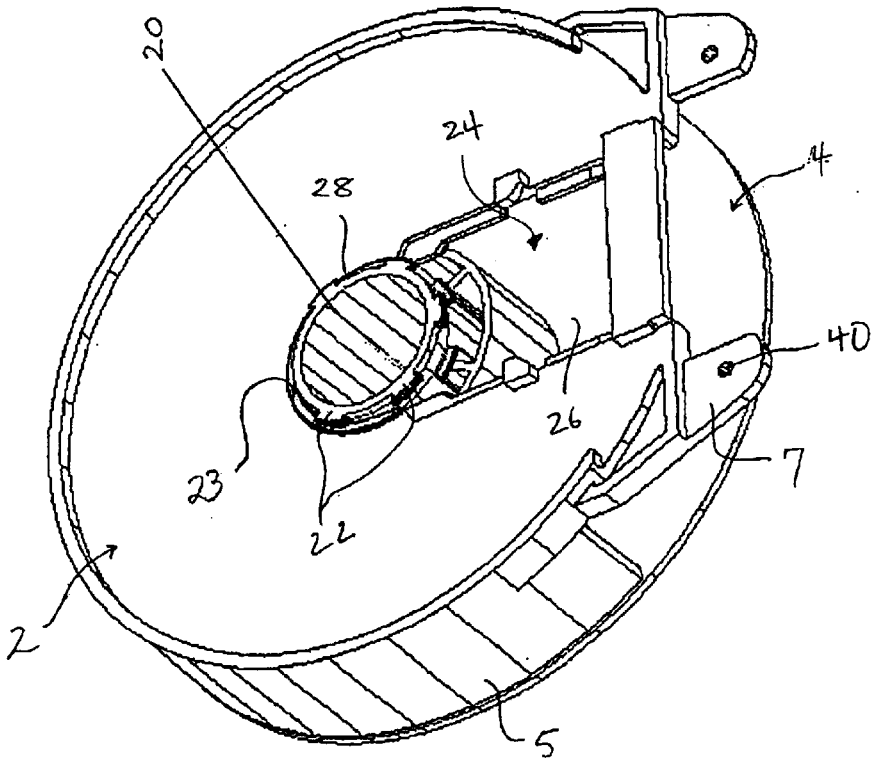
FIGS. 3 and 3A show a bottom view of the cover secured to the housing without and with the OD connector module secured to the housing, respectively.
Figure 3A:
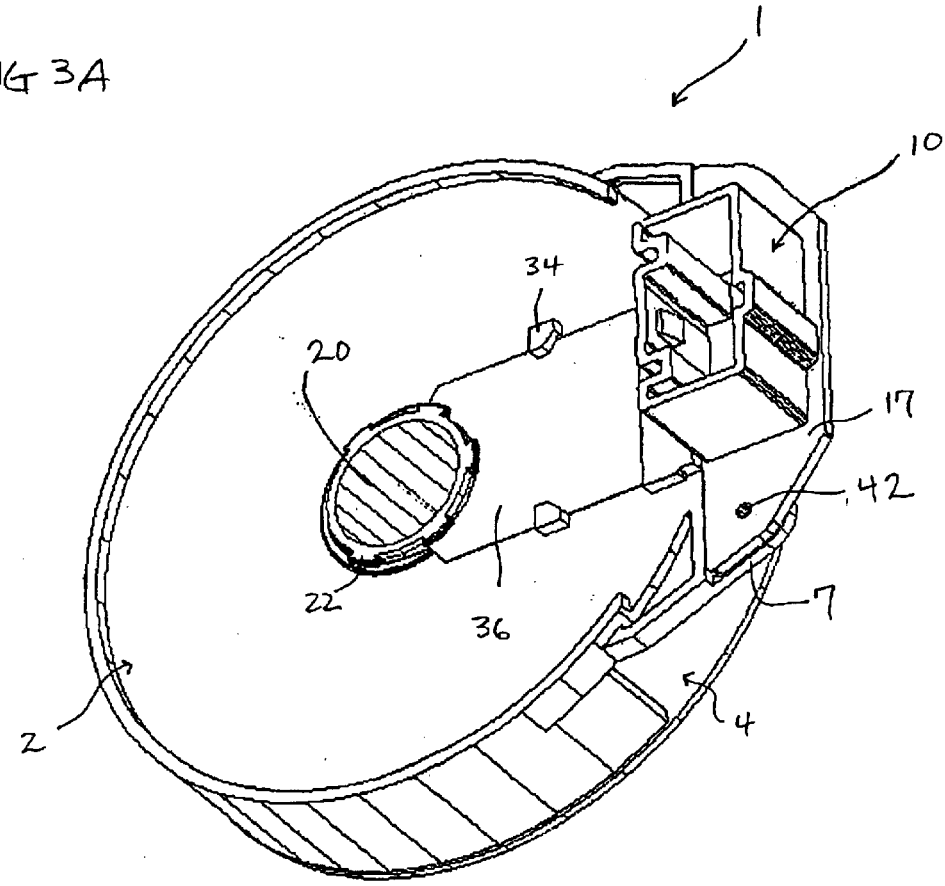
Figure 4:
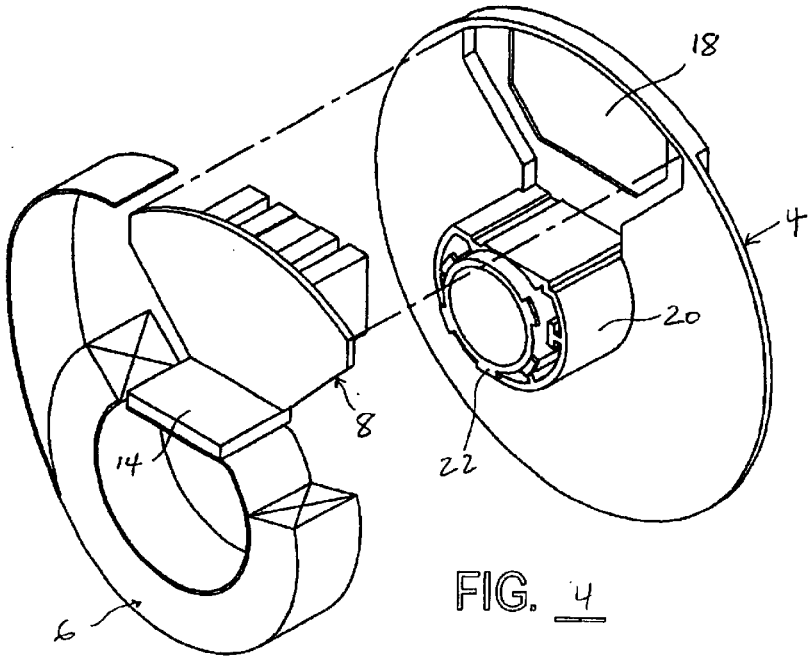
FIGS. 4 and 4A are perspective views of the ID connector module and flat cable before and after attachment to the cover plate, respectively.
Figure 4A:
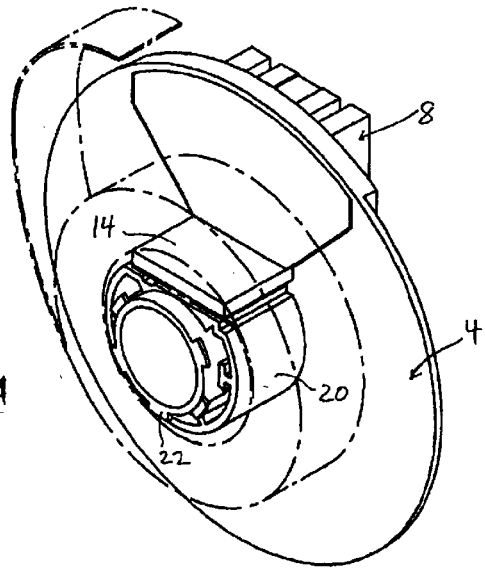

Referring now to FIGS. 3 and 3A, the hub 20 has outwardly extending flanges 22 that slide into a slot 24 in the housing 2. The slot 24 has two sections, an outer section 26 and an inner section 28, the outer section 26 having a slightly larger width than the inner section 28. The width of the outer section 26 is constructed so that the hub 20 and its flanges 22 may pass through. The width of the inner section 28 of the slot is sized so that only the hub 20 may pass through.

After the hub 20 is inserted though the outer section 26 of the slot, it is slid towards the center of the housing 2, into the inner section 28. The flanges 22 engage the circular edge 23 of the housing inner section 28, thus preventing the cover 4 from separating from the housing 2. The cover plate 4 rests on top of the housing walls 5 and seals the interior of the housing 2.

Figure 2:
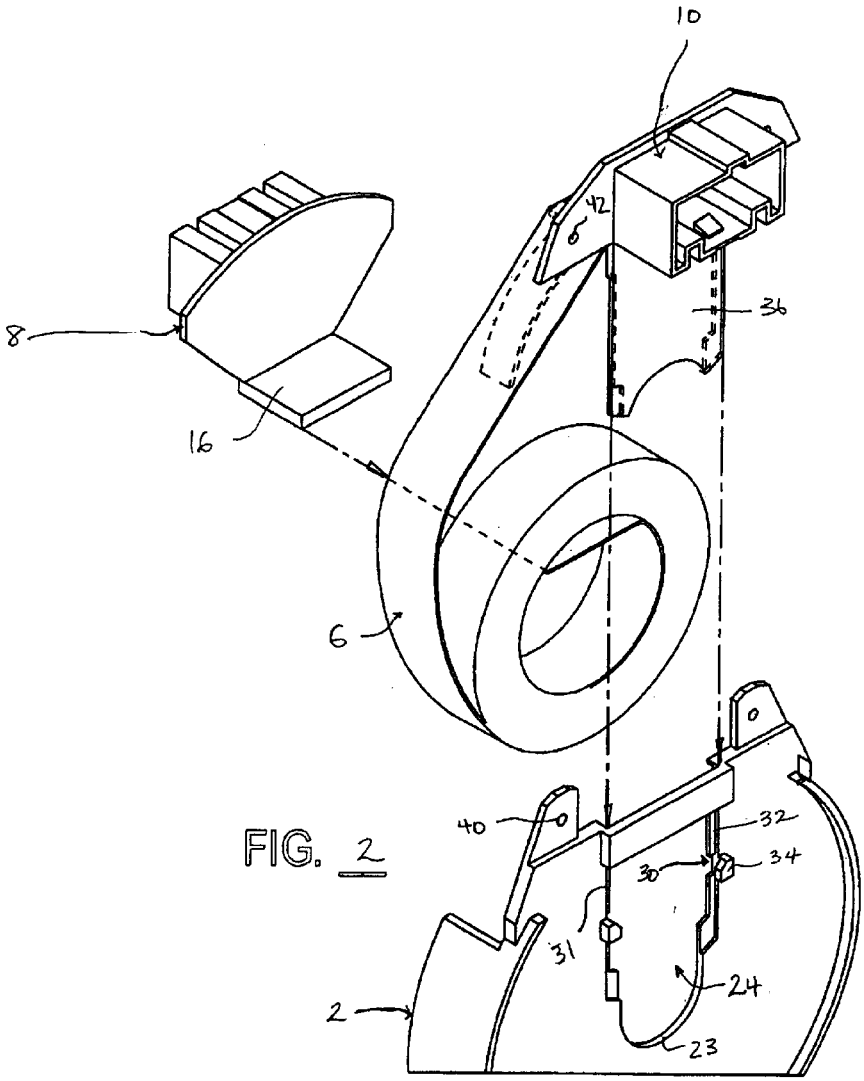
FIG. 2 is an exploded perspective view of the housing, the flat electrical cable, the ID connector module and the OD connector module.

Reference is now made to FIGS. 2 and 3A, which show how the OD connector module 10 is secured to the housing 2. The outside edges 31 of the slot 24 have grooves 30 defined by a ledge 32 and a bracket 34. The OD connector module 10 includes a forwardly extending lip 36 that slides into the groove 30 and is secured in-between the ledge 32 and bracket 34, as shown in FIG. 3A. The front of the lip 36 fits around the hub 20, underneath the flanges 22, to securely hold the hub 20 against the housing 2.

Figure 6:
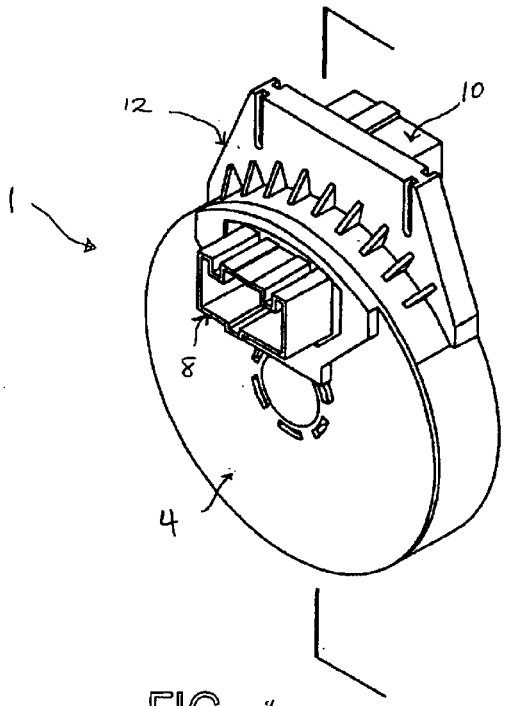
FIG. 6 is a perspective view of the clockspring of the present invention in an assembled condition.
Figure 5:
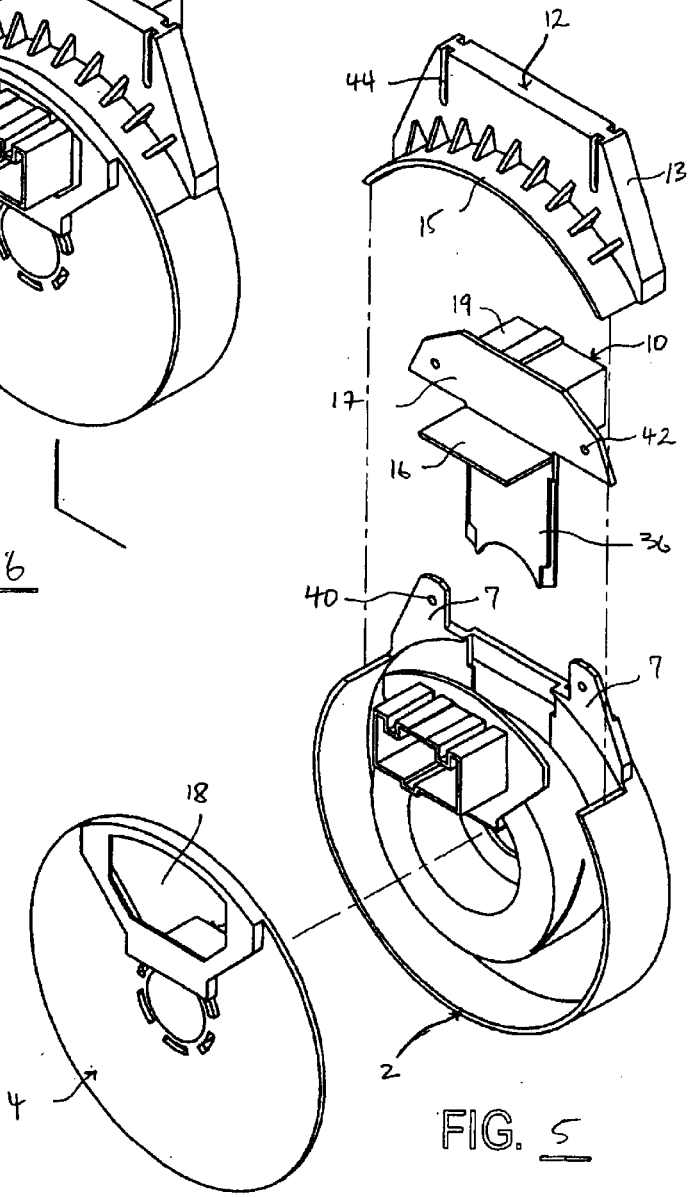
FIG. 5 is a perspective view of the clockspring of the present invention with the flat cable in the housing.

Now, referring to FIGS. 3A, 5 and 6, the attachment of the locking module 12 to the housing 2 is now described. FIG. 3A shows the OD connector module 10 secured to the housing 2, such that the base plate 17 of the OD connector module 10 sits atop the ear portions 7 of the housing 2. The ear portions 7 and the base plate 17 have apertures 40 and 42, respectively, for insertion of a pin (not shown) or other attachment means.

FIG. 5 shows an exploded view of the cover 4 removed from the housing 2 for purposes of clarity, but it should be understood that prior to attachment of the locking module 12 onto the housing 2, the cover 4 is secured to the housing 2 as described above. The locking module 12 includes a base portion 13 having a grooved interior (not shown) that slides around a base plate 17 of the OD connector module 16 and ear portions 7 of the housing 2. The contour of the grooved interior of the base portion 13 matches the contour of the base plate 17 and ear portions 7 to provide a tight fit. A top portion of the base portion 13 is partially removed so that the locking module 12 fits around a receptacle portion 19 the OD connector module 10. A final assembled clockspring 1 is shown in FIG. 7.

The modular clockspring of the present invention has several independent modules, in particular the ID connector module 8, the OD connector module 10, the cover 4, the housing 2, the flat electrical cable 6 and the locking module 12, so that typical changes in system requirements do not necessitate a complete redesign of the clockspring 1. For example, a change in the mounting style would only require a change in the housing structure, or a change in the number of circuits would require only changing the type of flat cable used or the ID and OD connector modules.

The clockspring of the present invention has been designed so that specific modules thereon may be altered without affecting the remaining modules of the clockspring. This allows manufacturers the flexibility to vary specific modules to meet the needs of different systems without costly redesigns. Furthermore, this clockspring can serve as the base for a line of clocksprings to serve a variety of different vehicle models because various clocksprings would have several common modules. This would reduce the manufacturing and inventory costs as there are less parts to design, manufacture and store.

Although only preferred embodiments are specifically illustrated and described herein, it will be appreciated that many modifications and variations of the present invention are possible in light of the above teachings and within the purview of the appended claims without departing from the spirit and intended scope of the invention.

We claim:

1. A modular clockspring having a plurality of individually modifiable modules, comprising:

a housing module and a cover module which are generally circular shaped and matable to form an enclosure, a flat cable module placed inside the enclosure formed by the housing module and cover module, an ID connector module secured to an inner end of the flat cable module and an OD connector module secured to an outer end of the flat electrical cable, and the housing module including a slot extending from the center of the housing module to the outer perimeter of the housing module, the slot receiving a hub extending from the cover module.

2. The modular clockspring of claim 1, wherein the ID connector module protrudes through an opening in the cover module, and the ID connector module and the cover module are capable of rotating simultaneously relative to the housing module.

3. The modular clockspring of claim 1, wherein the clockspring is used in a steering column of an automobile.

4. The modular clockspring of claim 1, wherein the slot has an outer slot section and an inner slot section, the outer slot section has a greater width than the inner slot section, and the hub includes flanges on an end thereof, the hub being adapted to be inserted into the outer slot section and then moved to the inner slot section, the flanges engaging the edges of the inner slot section to mate the cover module to the housing module.

5. The modular clockspring of claim 4, wherein the housing module slot includes a groove along the sides of the slot, and wherein the OD connector module includes a lip that is inserted into the groove to secure the OD connector module to the housing module.

6. The modular clockspring of claim 5, further comprising a locking module that mates with the housing module and the OD connector module to secure the OD connector module to the housing module.

7. A modular clockspring for use in automobiles, the clockspring having modules, each module capable of being modified without affecting the other modules of the clockspring, the clockspring comprising:

a housing module and a cover module providing an enclosure and holding a flat cable module, an ID connector module secured to an inner end of the flat cable module and an OD connector module secured to an outer end of the flat cable module, the ID connector module being adapted to be connected to a component in a steering column and the OD connector module being adapted to be connected to a component in another part of the vehicle; and the cover module includes a hub and the flat cable module is placed around the hub, the hub having flanges on an outer end thereof, the flanges engaging a slot in the housing module to secure the cover module to the housing module.

8. The modular clockspring for use in an automobile of claim 7, wherein the ID connector module protrudes through an opening in the cover module, and the ID connector module and the cover module are capable of rotating relative to the housing module.

9. The modular clockspring for use in an automobile of claim 7, wherein the slot in the housing module has a groove along its sides, and the OD connector module includes a lip that engages the groove and abuts against the hub to secure the cover module to the housing module.

10. The modular clockspring for use in an automobile of claim 7, further comprising a locking module that mates with the housing module and the OD connector module to secure the OD connector module to the housing module.

* * * * *